US005330553A

United States Patent [19]

Weinl et al.

[11] Patent Number: 5,330,553

[45] Date of Patent: Jul. 19, 1994

[54] SINTERED CARBONITRIDE ALLOY WITH HIGHLY ALLOYED BINDER PHASE

[75] Inventors: Gerold Weinl, Alvsjo; Rolf G. Oskarsson, Ronninge; Per Gustafsson, Hiddinge, all of Sweden

[73] Assignee: Sandvik AB, Sandviken, Sweden

[21] Appl. No.: 886,876

[22] Filed: May 22, 1992

[30] Foreign Application Priority Data

May 24, 1991 [SE] Sweden ..... 9101591-7

[51] Int. Cl.[5] ..... C22C 29/02

[52] U.S. Cl. ..... 75/236; 75/237; 75/238; 75/239; 75/240; 75/242; 419/13; 419/14; 419/16; 419/18; 419/17

[58] Field of Search ..... 75/236, 238, 239-242, 75/244, 246; 419/13-14, 18-16, 25, 32, 38, 54, 58, 60

[56] References Cited

U.S. PATENT DOCUMENTS 3,971,656 7/1976 Rudy ..... 75/203
4,775,521 10/1988 Siddon et al. ..... 423/561 R
4,904,445 2/1990 Iyori et al. ..... 419/13
4,957,548 9/1990 Shima et al. ..... 75/238
4,983,212 1/1991 Iyori et al. ..... 75/238
5,041,261 8/1991 Buljan et al. ..... 419/11
5,059,491 10/1991 Odani et al. ..... 428/614

FOREIGN PATENT DOCUMENTS 3528308 5/1986 Fed. Rep. of Germany .
1499278 1/1978 United Kingdom .

*Primary Examiner*—Donald P. Walsh
*Assistant Examiner*—Ngoclan T. Mai
*Attorney, Agent, or Firm*—Burns, Doane, Swecker & Mathis

[57] ABSTRACT

A sintered titanium-based carbonitride alloy contains hard constituents based on, in addition to Ti, W and/or Mo, one or more of the metals Zr, Hf, V, Nb, Ta or Cr in 5-30% binder phase based on Cobalt and/or nickel. The content of tungsten and/or molybdenum, preferably molybdenum in the binder phase is >1.5 times higher than in the rim and >3.5 times higher than in the core of adjacent hard constituent grains. The alloy is produced by a particular method.

2 Claims, No Drawings

SINTERED CARBONITRIDE ALLOY WITH HIGHLY ALLOYED BINDER PHASE

BACKGROUND OF THE INVENTION

The present invention relates to a sintered carbonitride alloy with titanium as main component and containing molybdenum. This alloy is preferably used as an insert for milling and turning. By starting the sintering with an oxidizing treatment, it is possible to obtain a high molybdenum-content in the binder phase which gives the alloy improved properties.

Classic cemented carbide, i.e., based upon tungsten carbide (WC) and with cobalt (Co) as binder phase has in the last few years met with increased competition from titanium-based hard materials, usually called cermets. In the beginning, these titanium-based alloys were used only for high speed finishing because of their extraordinary wear resistance at high cutting temperatures. This property depends essentially upon the good chemical stability of these titanium-based alloys. The toughness behavior and resistance to plastic deformation were not satisfactory, however, and therefore the area of application was relatively limited.

Development has proceeded and the area of application for sintered titanium-based hard materials has been considerably enlarged. The toughness behavior and the resistance to plastic deformation have been considerably improved. This has been done, however, by partly sacrificing the wear resistance.

An important development in titanium based hard alloys is the substitution of carbides by nitrides in the hard constituent phase. This decreases the grain size of the hard constituents in the sintered alloy. Both the decrease in grain size and the use of nitrides lead to the possibility of increasing the toughness at unchanged wear resistance. Characteristic for said alloys is that they are usually considerably more finegrained than normal cemented carbide, i.e., WC-Co-based hard alloy. Nitrides are also generally more chemically stable than carbides which results in lower tendencies to stick to work piece material or wear by solution of the tool.

Besides Ti, the other metals of the groups VIa, Va and VIa, i.e., Zr, Hf, V, Nb, Ta, Cr, Mo and/or W, are normally used as hard constituent formers as carbides, nitrides and/or carbonitrides. The grain size of the hard constituents is generally $<2$ μm. As binder phase nowadays both cobalt and nickel are used. The amount of binder phase is generally 3–25% by weight. In addition, also other metals are used, for example aluminum, which sometimes are said to harden the binder phase and sometimes improve the wetting between hard constituents and binder phase, i.e., facilitate the sintering.

During sintering the relatively seen less stable hard constituents are dissolved in the binder phase and precipitate then as a rim on the more stable hard constituents. A very common structure in the alloys in question is therefore hard constituent grains with a core-rim structure. An early patent in this area is U.S. Pat. No. 3,971,656 which comprises Ti-and N-rich cores and rims rich in Mo, W and C. Through U.S. patent application Ser. No. 07/543,474 filed Jun. 26, 1990 and herein incorporated by reference, it is known that at least two different combinations of duplex core-rim-structures in well balanced proportions give optimal properties regarding wear resistance, toughness behavior and/or plastic deformation. Further examples of patents in this area are U.S. Pat. Nos. 4,904,445, 4,775,521, 4,957,548.

As a result of the dissolution of the hard constituents in the binder phase during sintering, the binder phase will contain a certain part of these in solid solution which affects the properties of the binder phase and thereby those of the whole alloy. The composition of the binder phase is determined by the starting raw materials as well as the way of manufacture, i.a., time and temperature during the sintering. It would be desirable to increase the alloying of group VI elements in order to obtain a more rigid alloy which gives improved resistance against mechanical stresses, i.e., a tougher behavior. However, such alloying has not heretofore been practically available.

OBJECTS AND SUMMARY OF THE INVENTION

It is an object of this invention to avoid or alleviate the problems of the prior art.

It is further an object of this invention to provide a sintered titanium-based carbonitride alloy having an increased rigidity and a method for producing such alloys.

In one aspect of the invention, there is provided a sintered titanium-based carbonitride alloy containing hard constituents based on, in addition to Ti, W and/or Mo, and at least one metal selected from the group consisting of Zr, Hf, V, Nb, Ta or Cr in 5–30% binder phase based on cobalt and/or nickel and said sintered carbonitride alloy containing hard constituent grains with core-rim structure, the content of molybdenum and/or tungsten, in the binder phase is $>1.5$ times higher than in the rim and $>3.5$ times higher than in the core of adjacent hard constituent grains with core-rim structure.

In another aspect of the invention, there is provided a method of manufacturing a sintered carbonitride alloy comprising: wetmilling of powders forming binder phase and powder forming hard constituents to a powder mixture with desired composition; compacting said mixture to form compacts; and sintering said compacts in oxygen or air at 100°–300° C. for 10–30 minutes, in vacuum at a temperature of 1100°–1200° C., in vacuum at a temperature of about 1200° C. for about 30 minutes, in deoxidizing $H_2$-atmosphere for 15–30 minutes at about 1200° C., in $N_2$-atmosphere during heating to a sintering temperature of 1400°–1600° C., and cooling to room temperature in vacuum or inert gas.

DETAILED DESCRIPTION OF THE PREFERRED EMBODIMENTS OF THE PRESENT INVENTION

According to the invention, a titanium-based carbonitride alloy with improved rigidity is provided. By a special way of manufacture, it has surprisingly turned out to be possible to obtain an alloy with higher content of molybdenum and/or tungsten in the binder phase relative to the hard constituents than previously possible. In an alloy according to the invention, the content of molybdenum and/or tungsten, preferably molybdenum, in the binder phase is $>1.5$ times greater than the content of said elements in the rim and $>3.5$ times the content in the core of adjacent hard constituent grains with core-rim-structure.

A titanium based carbonitride alloy according to the invention is manufactured by powder metallurgical methods. Powders forming binder phase and powders forming the hard constituents are mixed to a mixture with desired composition, preferably satisfying the relation $0.3<N/(N+C)<0.6$ where N is the nitrogen content and C is the carbon content.

From the mixture, bodies are pressed and sintered. After dewaxing, the sintering is started with an oxidizing treatment in oxygen or air at 100°-300° C. for 10-30 min whereafter vacuum is pumped and maintained up to 1100°-1200° C., followed by a deoxidizing treatment in vacuum at 1200° C. for 30 min which afterwards is replaced by a deoxidizing $H_2$-atmosphere during a certain time of, e.g., 30 minutes to deoxidize the bodies at about 1200° C. whereupon the temperature is increased to sintering temperature, 1400°-1600° C., in a nitrogen atmosphere. During the said temperature increase and/or sintering time, a gradual decrease of the nitrogen content to zero can take place. Up to about 100 mbar Ar can with advantage be introduced during the sintering period. The cooling to room temperature takes place in vacuum or in inert gas.

The reason to the relatively seen high content of molybdenum and/or tungsten in the binder phase using the method according to the invention is not completely clear. While we do not wish to be bound to any theory, it is believed to probably be due to the special distribution of nitrogen in the carbide raw material which is obtained through the introductory oxidation-, reduction- and nitriding steps. The oxidation- and reduction-steps result in carbon loss leading to an influence on the interstitial balance of the oxycarbonitrides, particularly in carbide surface close areas. During the nitriding steps, vacant interstitial positions are filled with nitrogen whereby carbonitrides with an increased content of nitrogen in the rim can be expected. The carbonitrides obtained according to the above constitute, during the initial stages of the sintering, very effective nitrogen sources whereby an increased nitrogen potential during the period when the core-rim structure is formed, can be expected. The distribution of molybdenum between binder phase and hard constituent is influenced by the nitrogen potential in such a way that high nitrogen potential leads to high content of molybdenum in the binder phase relative to the hard constituent phase. The method gives, thus, a high molybdenum-content in the binder phase at the same time as the weighed-in nitrogen content totally is low. Chemical analysis shows that the total nitrogen content increases 10-15% relatively during sintering.

The invention is additionally illustrated in connection with the following Examples which are to be considered as illustrative of the present invention. It should be understood, however, that the invention is not limited to the specific details of the Examples.

EXAMPLE 1

A powder mixture consisting of (in % by weight) 12.4% Co, 6.2% Ni, 34.9% TiN, 7.0% TaC, 4.4% VC, 8,7% $Mo_2C$ and 26.4 TiC was wetmilled, dried and pressed to inserts of type TNMG 160408-QF which were sintered according to the following steps:

a) dewaxing in vacuum
b) oxidation in air for 15 minutes at 150° C.
c) heating in vacuum to 1200° C.
d) deoxidation in vacuum at 1200° C. for 30 minutes
e) flowing $H_2$ at 10 mbar for 15 minutes at 1200° C.
f) flowing $N_2$ during heating to 1200°-1500° C.
g) sintering in Ar at 10 mbar and 1550° C. for 90 minutes
h) cooling in vacuum X-ray diffraction analysis showed presence of cubic carbonitride and binder phase. The lattice constant of the binder phase was 3.594 Å which shows that the alloying content is increased.

For comparison inserts of the same type and the same composition were manufactured according to U.S. Pat. No. 5,059,491.

The ratio between the contents of molybdenum in the binder phase and the rim, resp., core in hard constituent grains in the alloy according to the invention and according to known technique was determined with EDS-analysis with the following result:

| | Binder phase/rim | Binder phase/core |
|---|---|---|
| According to the invention | 1.7 | 4 |
| According to known technique | 1.3 | 2.9 |

EXAMPLE 2

The inserts from example I were tested in an intermittent turning operation under the following conditions:

Work piece: SS 2244
Cutting speed: 110 m/min
Cutting depth: 1.5 mm
Feed: 0.11 mm/rev which was increased continuously (doubled every 90:th second)
Result: 50% of the inserts according to the invention fractured after 1.41 min which corresponds to a feed of 0.21 mm/rev whereas 50% of the prior art inserts fractured after 0.65 min which corresponds to a feed of 0.16 mm/rev.

Inserts according to the invention, thus, show a significantly better toughness.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Sintered titanium-based carbonitride alloy containing hard constituents of a carbide, nitride, carbonitride or combinations thereof of Ti, at least one of W and Mo and at least one metal selected from the group consisting of Zr, Hf, V, Nb, Ta and Cr in 5-30% binder phase of a metal selected from the group consisting of cobalt, nickel and alloys thereof, and said sintered carbonitride alloy containing hard constituent grains with a core-rim structure, the content of molybdenum and/or tungsten in the binder phase being >1.5 times higher than in the rim and >3.5 times higher than in the core of adjacent hard constituent grains with core-rim structure.

2. The sintered titanium-based carbonitride alloy of claim 1 wherein the molybdenum content in the binder phase is >1.5 times higher than in the rim and >3.5 times higher than in the core of adjacent hard constituent grains with core-rim structure.

* * * * *